US008900073B2

(12) United States Patent
Lee et al.

(10) Patent No.: US 8,900,073 B2
(45) Date of Patent: Dec. 2, 2014

(54) GOLF TEE AND MANUFACTURING METHOD THEREOF

(75) Inventors: Hyung Choon Lee, Seoul (KR); Sung Eun Lee, Seoul (KR)

(73) Assignee: Koviss Sports Co., Ltd., Bucheon-si, Gyeonggi-do (KR)

( * ) Notice: Subject to any disclaimer, the term of this patent is extended or adjusted under 35 U.S.C. 154(b) by 0 days.

(21) Appl. No.: 13/876,638

(22) PCT Filed: Apr. 26, 2012

(86) PCT No.: PCT/KR2012/003241

§ 371 (c)(1), (2), (4) Date: Apr. 30, 2013

(87) PCT Pub. No.: WO2013/162101

PCT Pub. Date: Oct. 31, 2013

(65) Prior Publication Data

US 2013/0337944 A1 Dec. 19, 2013

(51) Int. Cl.
*A63B 57/00* (2006.01)

(52) U.S. Cl.
CPC ..... *A63B 57/0018* (2013.01); *A63B 57/00* (2013.01)
USPC ..... 473/387; 473/396

(58) Field of Classification Search
CPC ... A63B 57/00; A63B 57/0018; A63B 57/005
USPC ..... 473/387–403; D21/717, 719
See application file for complete search history.

(56) References Cited

U.S. PATENT DOCUMENTS

| | | | | | |
|---|---|---|---|---|---|
| 4,786,054 | A * | 11/1988 | Keys | 473/268 |
| 5,242,170 | A * | 9/1993 | Ward | 473/396 |
| 6,010,413 | A * | 1/2000 | Pan-Chung | 473/402 |
| 6,224,501 | B1 * | 5/2001 | Rudduck et al. | 473/401 |
| 6,783,470 | B2 * | 8/2004 | Lee | 473/401 |
| D516,648 | S * | 3/2006 | Lee et al. | D21/718 |
| 7,011,586 | B2 * | 3/2006 | Toyosawa et al. | 473/401 |
| D555,218 | S * | 11/2007 | Lee et al. | D21/718 |
| 7,374,501 | B2 * | 5/2008 | Lu | 473/396 |
| 7,494,429 | B2 * | 2/2009 | Lee | 473/396 |

(Continued)

FOREIGN PATENT DOCUMENTS

| | | | |
|---|---|---|---|
| KR | 10-2005-0035969 | A | 4/2005 |
| KR | 20-0387175 | Y1 | 6/2005 |
| KR | 10-2009-0102228 | A | 9/2009 |

OTHER PUBLICATIONS

International Search Report of PCT/KR2012/003241 dated Oct. 29, 2012.

(Continued)

*Primary Examiner* — Steven Wong
(74) *Attorney, Agent, or Firm* — Lucas & Mercanti, LLP

(57) ABSTRACT

Disclosed is a golf tee including a main body having an upper seat on which a golf ball is supported; an insertion pin having a lower pointed part; and a connection pin connecting the insertion pin and the main body, the connection pin including an upper integral-type head part and a body part extending from the head part and having a lower screw section on a lower end thereof and around which a spring is integrally fitted, the insertion pin having an elongated screw hole extending from an upper central portion thereof such that the screw part of the connection pin is screwed therethrough.

12 Claims, 10 Drawing Sheets

(56) References Cited

U.S. PATENT DOCUMENTS

| | | | | |
|---|---|---|---|---|
| 7,780,552 | B2 | 8/2010 | Rhee | |
| D696,365 | S * | 12/2013 | Lee et al. | D21/718 |
| 8,684,867 | B2 * | 4/2014 | Murphy | 473/387 |
| 2002/0022538 | A1 * | 2/2002 | Choi | 473/396 |
| 2003/0148830 | A1 | 8/2003 | Hsiao | |
| 2005/0070379 | A1 * | 3/2005 | Gilmour | 473/400 |
| 2005/0143195 | A1 * | 6/2005 | Syu | 473/396 |
| 2006/0105861 | A1 * | 5/2006 | Yang | 473/396 |
| 2006/0229144 | A1 * | 10/2006 | Lee | 473/393 |
| 2007/0111825 | A1 * | 5/2007 | Lee | 473/386 |
| 2007/0149324 | A1 * | 6/2007 | Tsai | 473/387 |
| 2007/0298909 | A1 * | 12/2007 | Lu | 473/393 |
| 2012/0028736 | A1 * | 2/2012 | Rhee | 473/398 |

OTHER PUBLICATIONS

Korean Office Action (Korean Patent Application No. 10-2012-0043593) dated Aug. 1, 2013.

* cited by examiner

GOLF TEE AND MANUFACTURING METHOD THEREOF

CROSS-REFERENCE TO RELATED APPLICATIONS

This application is a 371 of PCT/KR2012/003241 filed on Apr. 26, 2012, and further claims the benefit of Korean Patent Application No. 10-2012-0043593 filed on Apr. 26, 2012, the contents of each of which are incorporated herein by reference.

Technical Field

The present invention relates, in general, to a golf tee and a manufacturing method thereof and, more particularly, to a golf tee in which a main body thereof and an insertion pin thereof are stably connected by a connection pin and which has less parts and therefore requires less assembly processes in its assembly, and a manufacturing method thereof.

Background Art

Generally, a golf tee is a stand that is used in the game of golf and is inserted into turf and used to support a golf ball so that a player can strike the golf ball when the player takes a drive shot.

A conventional golf tee is a piece made of a non-elastic material such as wood, plastic, or the like in which an upper part thereof is formed to be concave so as to support the golf ball thereon, and a lower part thereof is formed to be sharp so that a player can stick it into the turf.

Since the conventional golf tee is made of a hard material, when a player strikes the golf ball with a golf club, the golf tee undergoes a strong impact from a head of the golf club, so it may be wastefully broken or lost due to a strong strike. Also, the golf tee influences the trajectory of a golf ball. That is, when striking the golf ball, friction resistance exists between the golf ball and the upper part of the golf tee, and if the golf tee is broken, the type or direction of the breakage may affect the trajectory of the golf ball, so the golf ball may not be precisely and clearly hit to a desired location.

To solve these problems, a bent type golf tee has been proposed in which a main body thereof on which the golf ball is supported, and a lower pointed insertion part to be inserted into the turf are separated, so that the lower part can be bent toward a striking direction.

As shown in FIG. 1 of Korean Patent Publication No. 10-0730023 assigned to the applicant, a golf tee is provided, which includes a tubular main body having a step part on a lower inner circumference, and an insertion part having a lower pointed end with a central elongated coupling hole formed vertically therealong, which is connected with the main body by a connection pin while being elastically supported by a spring. Here, the connection pin has a fitting type support head on its upper end so as to prevent the spring loaded in the main body from being separated. A lower end of the connection pin protrudes toward a lower side of the main body and is inserted into the insertion pin with a support member fitted around the lower end below which a thick part is formed.

In the golf tee, although the support head fitted around the upper portion of the connection pin serves to prevent the spring from being separated, the support head that is an injection-molded part may be broken due to an external impact, or may be separated from the main body by a coupling error, so the spring can be dislodged, or the main body and the insertion part can be separated and damaged.

Further, in the assembly of the golf tee, an assembly process in which the support head is interference-fitted around the upper side of the connection pin, and the upper side of the connection pin protruding above the support head is formed so as to be thick to thereby fix the support head to the connection pin is complicated. A coupling process in which the support pin fixedly pressure-fitted to the lower end of the connection pin is pressure-fitted into the coupling hole of the insertion pin is complicated. Then, when tolerances for an outer diameter of the support pin pressure-fitted to the connection pin and for an inner diameter of the coupling hole of the insertion pin are made high to facilitate pressure-fitting of the support pin, there may be a problem that the connection pin and the insertion pin can be easily separated when the golf ball is struck. Further, other problems exist in that a configuration is relatively complicated, the manufacture is not easy, and productivity is reduced.

DISCLOSURE

Technical Problem

Accordingly, the present invention has been made keeping in mind the above problems occurring in the related art, and is intended to provide a golf tee in which a connection pin is stably coupled to connect a main body and an insertion pin together, thereby stably maintaining sufficient flexibility and elasticity of the connection pin when a golf ball is hit at the start of each hole, preventing the main body and the insertion pin from being separated and broken, and preventing the golf tee from being bent due to the flexibility of a spring when it is inserted into turf and therefore improving a quality of a product.

Another object of the invention is to provide a method of manufacturing a golf tee which simplifies an assembly process by reducing the number of parts, thereby saving on a manufacturing cost and improving productivity.

Technical Solution

In an aspect, the present invention provides a golf tee including: a main body having an upper seat on which a golf ball is supported; an insertion pin having a lower pointed part; and a connection pin connecting the insertion pin and the main body, the connection pin including an upper integral-type head part and a body part extending from the head part and having a lower screw section on a lower end thereof and around which a spring is integrally fitted, the insertion pin having an elongated screw hole extending from an upper central portion thereof such that the screw part of the connection pin is screwed therethrough.

The main body may be provided on a lower end thereof with a coupling groove, and the insertion pin may be provided on an upper end thereof with a protrusion to be inserted into the coupling groove, wherein the coupling groove and the protrusion have a pair of male-female engaging steps. The coupling groove and the protrusion may have a pair of male-female screw parts.

A lower portion of the insertion pin may be formed as an inclined rib having a pointed tip and having a repairing function.

An inclined repairing member may be detachably coupled to a lower portion of the insertion pin, the repairing member having a pointed tip. Here, the repairing member may have a cap coupled to the lower portion of the insertion pin, and an inclined, pointed rib integrally extending from an end of the cap. The lower portion of the insertion pin may have a protrusion part on an outer circumference thereof, and the cap may have, on an inner circumference thereof, a groove part into which the protrusion part is fitted. Further, the insertion pin may have an opening at a distal end thereof, through which a flexible wire is connected to the bottom of the cap.

The insertion pin may have a plurality of circumferential rings at regular intervals to indicate an insertion level of the insertion pin.

Further, an elastic section may be provided inside the seat of the main body such that one side thereof is integrally coupled to an upper surface of the head part of the connection pin, so as to elastically support a golf ball.

In another aspect, the present invention provides a method of manufacturing a golf tee including a hollow main body having, on an inner circumference, a step part below which a coupling groove is formed, and an insertion pin assembled with the main body and having an upper protrusion, through which an elongated screw hole vertically extends from an upper central portion of the upper protrusion, and a lower pointed portion, the method including a stage S10 of providing an elastic connection pin having an upper large-diameter head part and a body part extending from the head part and having a screw section on a lower portion thereof and around which a spring is integrally coupled to the head part; a stage S20 of pushing the elastic connection pin, in which the spring is integrally coupled to the head part, down into the main body such that the spring is engaged against the step part of the main body and the screw section of the connection pin protrudes out of a lower portion of the main body; and a stage S30 of screwing the screw section of the connection pin protruding out of the lower portion of the main body through the screw hole of the insertion pin so as to connect the connection pin and the insertion pin.

The method may further include a stage of, after the stage of S30, coupling the upper protrusion of the insertion pin into the coupling groove of the main body.

Here, the coupling groove and the upper protrusion may be coupled using an engaging step and an engaging groove formed on the coupling groove and the upper protrusion.

Here, the coupling groove and the upper protrusion may be coupled using internal and external screw parts formed on the coupling groove and the upper protrusion.

A lower portion of the insertion pin may be formed as an inclined rib having a pointed tip and having a repairing function.

The method may further include a stage of, after the stage of S30, drilling a distal end of the insertion pin, and connecting a flexible wire through the drilled distal end of the insertion pin to a repairing member having a cap with a bottom, to which the flexible wire is coupled, and an inclined, pointed part extending from an end of the cap, such that the repairing member is fitted around the lower portion of the insertion pin.

The stage of S10 may further include a stage of integrally coupling an elastic section to an upper surface of the head part of the connection pin to elastically support a gold ball.

Advantageous Effects

According to a golf tee and a manufacturing method thereof of the present invention, when a main body and an insertion pin are assembled by inserting a connection pin into the main body, a screw section of the connection pin is screwed to a screw hole of the insertion pin to form a firm, stable assembly, thereby stably maintaining sufficient flexibility and elasticity of the connection pin when a golf ball is hit at the start of each hole, preventing the main body and the insertion pin from being separated and broken, and preventing the golf tee from being bent due to the flexibility of a spring when it is inserted into turf and therefore improving a quality of a product.

Further, the engagement between the main body and the insertion pin prevents a gold tee from being bent due to flexibility of a spring when inserting it into turf, thereby improving convenience of use.

Still further, parts such as a conventional support head, a support pin, and the like are not required, so the number of the parts is reduced, thereby saving on a manufacturing cost and maximizing productivity due to a simplified assembly process.

BEST MODE

Figure 1:
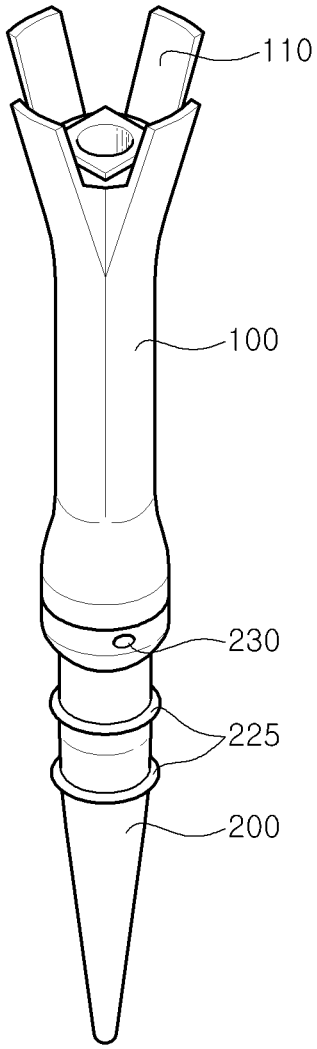
FIG. 1 is a perspective view showing a golf tee according to an illustrative embodiment of the invention.

The above and other objects, features and advantages of the present invention will be more clearly understood from the following detailed description when taken in conjunction with the accompanying drawings. Hereinafter, a gold tee and a manufacturing method thereof will be described in detail with reference to the accompanying drawings. In the description and drawings, unless otherwise indicated, the same reference numerals refer to the same or like parts.

Figure 2:
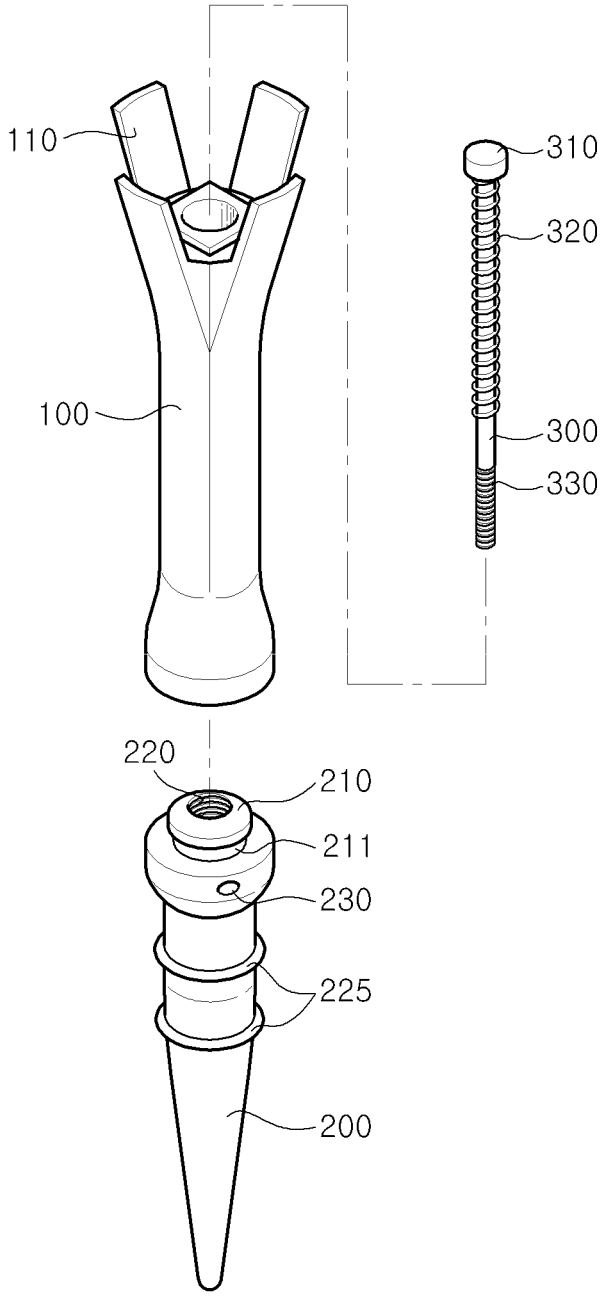
FIG. 2 is an exploded perspective view of the golf tee of the invention.
Figure 3:
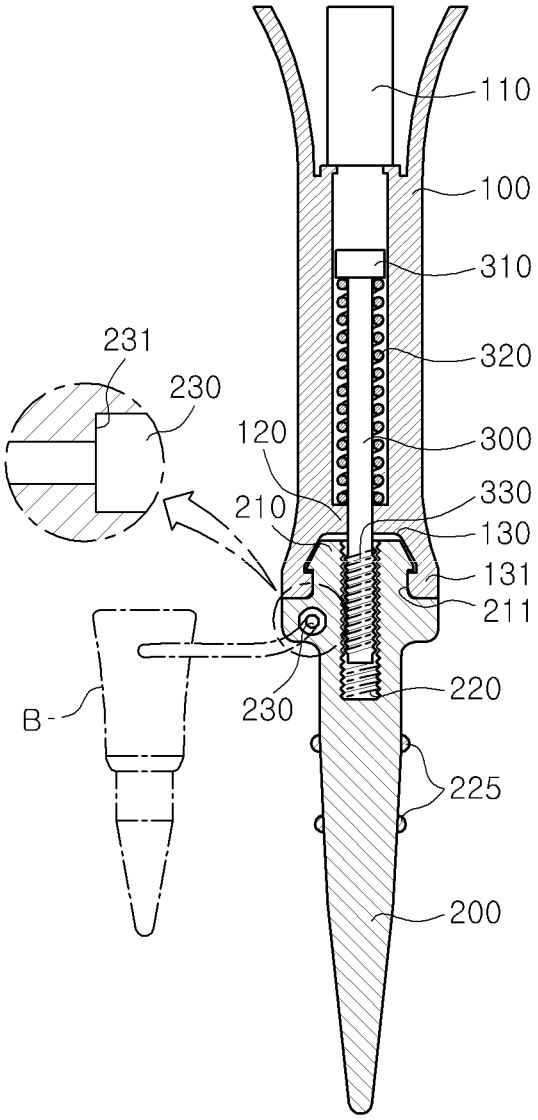
FIG. 3 is a sectional view of the golf tee of the invention.
Figure 4:
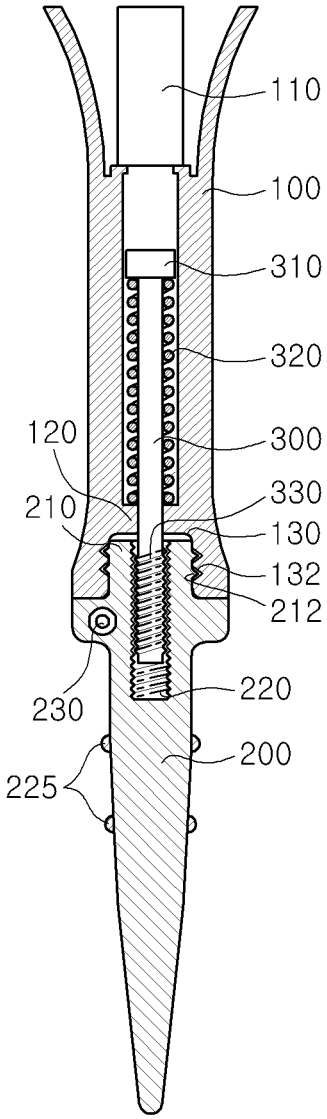
FIG. 4 is a sectional view of the gold tee in which a main body and an insertion pin are screwed together.
Figure 5:
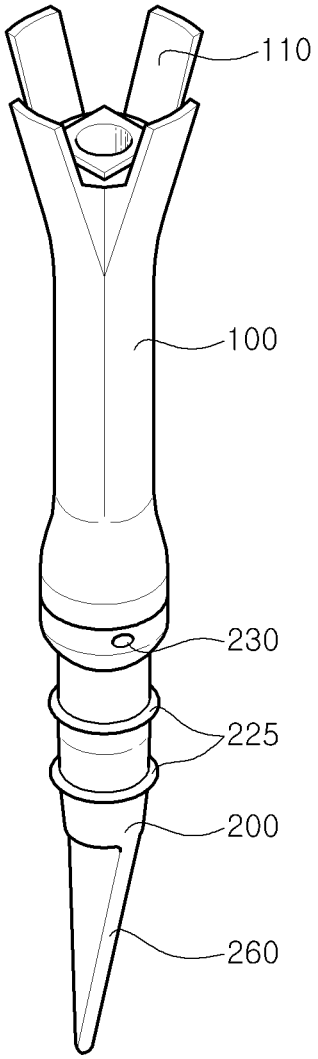
FIG. 5 is a perspective view of another example of an insertion pin of the golf tee according to the present invention.
Figure 6:
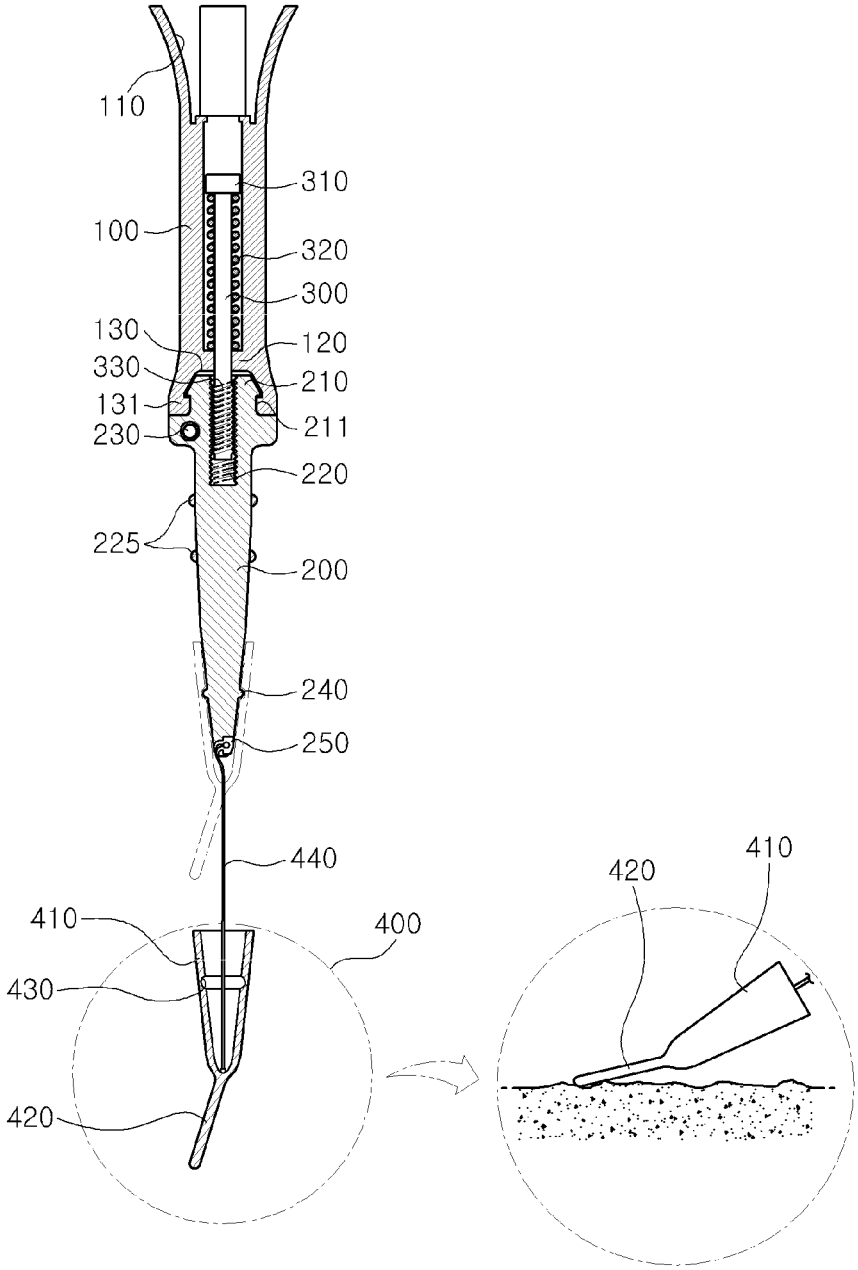
FIG. 6 is a sectional view of the golf tee in which a repairing member is detachably coupled to the insertion pin.
Figure 7:
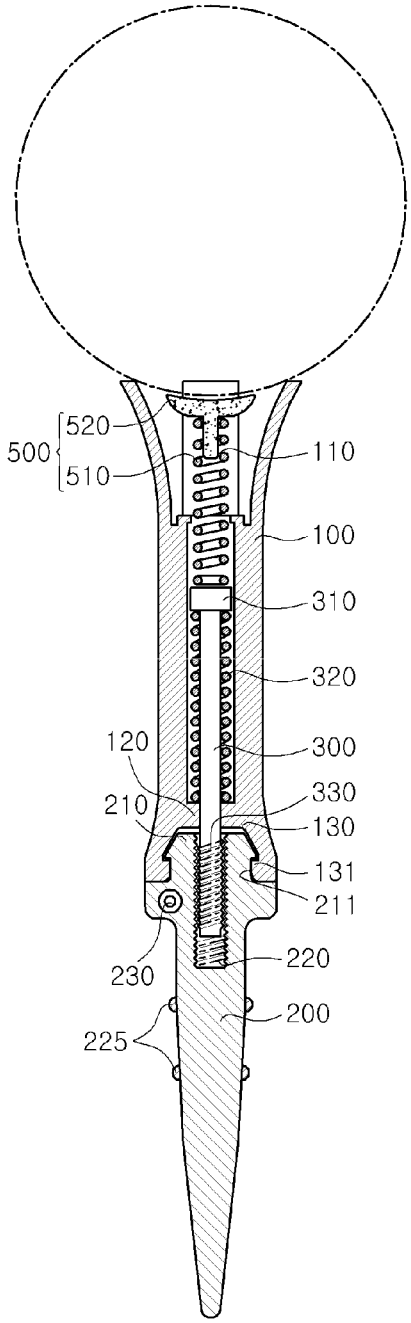
FIG. 7 is a sectional view of the golf tee in which an elastic section is provided on an upper side thereof.
Figure 8:
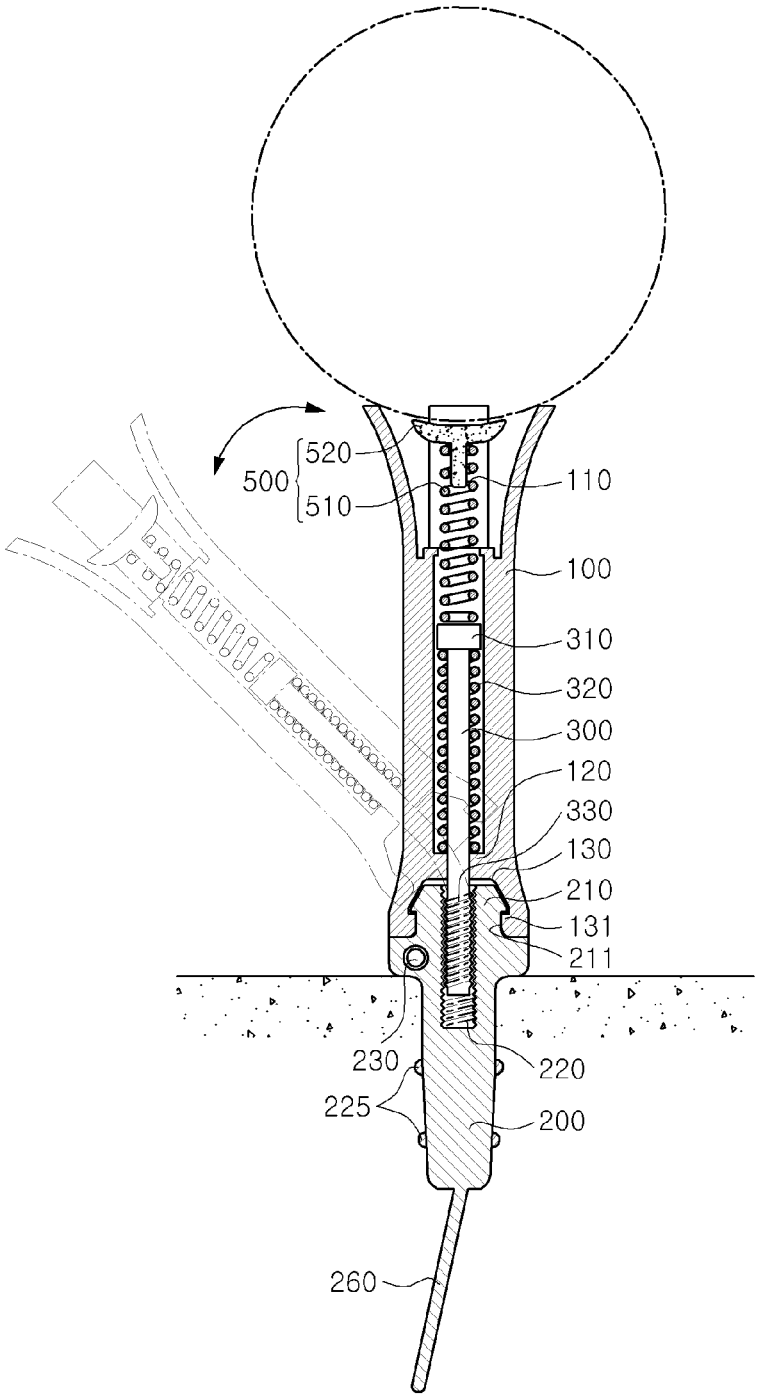
FIG. 8 is a view showing the state of the gold tee of the invention being inserted into the turf.

FIG. 1 is a perspective view showing a golf tee according to an illustrative embodiment of the invention, FIG. 2 is an exploded perspective view of the golf tee of the invention, FIG. 3 is a sectional view of the golf tee of the invention, FIG. 4 is a sectional view of the gold tee in which a main body and an insertion pin are screwed together, FIG. 5 is a perspective view of another example of an insertion pin of the golf tee according to the present invention, FIG. 6 is a sectional view of the golf tee in which a repairing member is detachably coupled to the insertion pin, FIG. 7 is a sectional view of the golf tee in which an elastic section is provided on an upper side thereof, and FIG. 8 is a view showing the state of the gold tee of the invention being inserted into the turf.

As shown in FIGS. 1 to 3, the golf tee according to the present invention includes a main body 100, an insertion pin 200, and a connection pin 300 which connects the main body and the insertion pin.

The main body 100 is formed like a hollow body which has an upper seat 110 on which a golf ball is supported, a step part 120 which is provided at a lower portion of an inner circumference thereof, and a coupling groove 130 which is provided below the step part 120. The coupling groove 130 has a leading engaging step 131.

The insertion pin 200 has an upper end having the same diameter as a distal end of the main body 100. The insertion pin has, on an upper surface thereof, a protrusion 210 which is inserted into the coupling groove 130 and has an engaging groove 211 into which the engaging step 131 of the coupling groove is fitted. An elongated screw hole 220 is vertically formed from an upper central portion of the protrusion 210. A lower portion of the insertion pin 200 has a small diameter compared to an upper portion of the insertion pin and has a pointed end so that it can be inserted into turf. The lower portion of the insertion pin has a plurality of circumferential rings 225 at regular intervals to indicate an insertion level of the insertion pin. Further, the insertion pin 200 has, on the upper side thereof, a binding hole 230 through which a strip or a band is tied and is connected to other golf tee or golf goods B to prevent the loss of the golf tee. Here, the binding hole 230 may be a stepped hole having a step 231 against which the strip or the band is engaged, so as to provide an attractive appearance.

The connection pin 300 integrally has an upper large-diameter head part 310 and a rod-type body part which extends from the head part and around which a spring 320 is integrally coupled to the head part 310. The body part has a screw section 330 at a lower portion thereof.

Here, the main body 100 is made of soft urethane to resist an impact of a tee shot. The insertion pin is made of a conventional synthetic resin. The connection pin 300 is made of a urethane material like the main body 100, so that the connection pin has an elastic restoration force.

As shown in FIG. 3, according to the golf tee having the above configuration, when the connection pin 300 is pushed down from an upper side into the main body 100, the spring 320 fixedly mounted around the connection pin 300 is engaged against the step part 120 and the screw section 330 of the lower portion of the connection pin 300 protrudes out of the lower portion of the main body 100 through the step part 120. Next, the screw hole 220 of the insertion pin 200 is screwed to the screw section 330 of the connection pin 300 that protruded out of the main body 100, and the protrusion 210 of the insertion pin 200 is pressure-fitted into the coupling groove 130 of the main body such that the engaging groove 211 formed on the protrusion 210 and the engaging step 131 formed on the coupling groove 130 are engaged together, thereby completing an assembly process.

Here, as shown in FIG. 4, in order to connect the main body 100 and the insertion pin 200 together, the coupling groove 131 of the main body 100 and the protrusion 210 of the insertion pin may be provided, on their inner and outer circumferences, respectively, with a pair of male-female screw parts 132 and 212 having one turn-type or one and a half turn-type so as to couple the protrusion 210 of the insertion pin and the coupling groove 130 of the main body together.

Further, as shown in FIG. 5, the insertion pin 200 may be formed as an inclined rib 260 having a pointed tip in order to provide a repairing function. That is, the inclined, pointed insertion pin 200 additionally serves to repair the turf when taken out of the ground by a player. Further, the pointed tip of the rib 260 allows itself to be easily inserted into the ground.

Further, as shown in FIG. 6, an inclined repairing member 400 having a pointed tip may be detachably mounted to the lower portion of the insertion pin 200.

Here, the repairing member 400 may have a cap 410 coupled to the lower portion of the insertion pin, and an inclined rib 420 which integrally extends from an end of the cap and has a pointed tip. In order to prevent the cap 410 from being separated and lost from the insertion pin 200, the insertion pin 200 may have a protrusion part 240 on an outer circumference of the lower portion, and the cap 410 may have, on an inner circumference thereof, a groove part 430 into which the protrusion part 240 is interference-fitted, so that the repairing member 400 is separated from the insertion pin 200 when a user pulls the cap by hand. Further, the insertion pin 200 may be drilled at a distal end to form an opening 250 through which a flexible wire 440 is connected to the bottom of the cap 410 so as to prevent the loss of the cap 410. Here, in the case where the insertion pin 200 and the cap 410 are connected by the wire 440, when a repairing event occurs, the cap 410 is separated from the insertion pin 200 and the repair is performed using the rib 420, and then only the insertion pin is inserted into the turf in order to hit the golf ball at the start of each hole.

As shown in FIG. 7, an elastic section 500 may further be provided inside the seat 110 of the main body 100 to elastically support the golf ball. Here, the elastic section 500 includes an upper support piece 520 and a spring 510 fixedly mounted between the support piece and an upper surface of the head part of the connection pin 300. Thus, when the golf ball is put on the support piece 520, the support piece 520 can more stably support the golf ball with an elastic force of the spring 510.

As shown in FIG. 8, according to the golf tee having the above configuration, when the main body 100 and the insertion pin 200 are assembled by inserting the connection pin 300 into the main body 100, the screw section 330 of the connection pin 300 is screwed to the screw hole 220 of the insertion pin 200. Thereby, sufficient flexibility and elasticity of the connection pin 300 is stably maintained when the golf ball is hit at the start of each hole. The connection pin 300 instantly vertically returns to its original condition due to self-elasticity, and the main body 100 and the insertion pin 200 also return to their original condition that they are connected together by elasticity of the spring 320.

The circumferential rings 225 of the insertion pin 200 which are provided at regular intervals facilitate the adjustment of the insertion level of the golf tee if needed, and improve insertion force of the golf tee when inserted into the turf, together with the rib 260. The engagement between the main body 100 and the insertion pin 200 prevents the golf tee from being bent due to the flexibility of the spring 320 when inserting the golf tee into the turf. Further, the elastic section provided in the seat facilitates more stable support of the golf ball.

Figure 9:
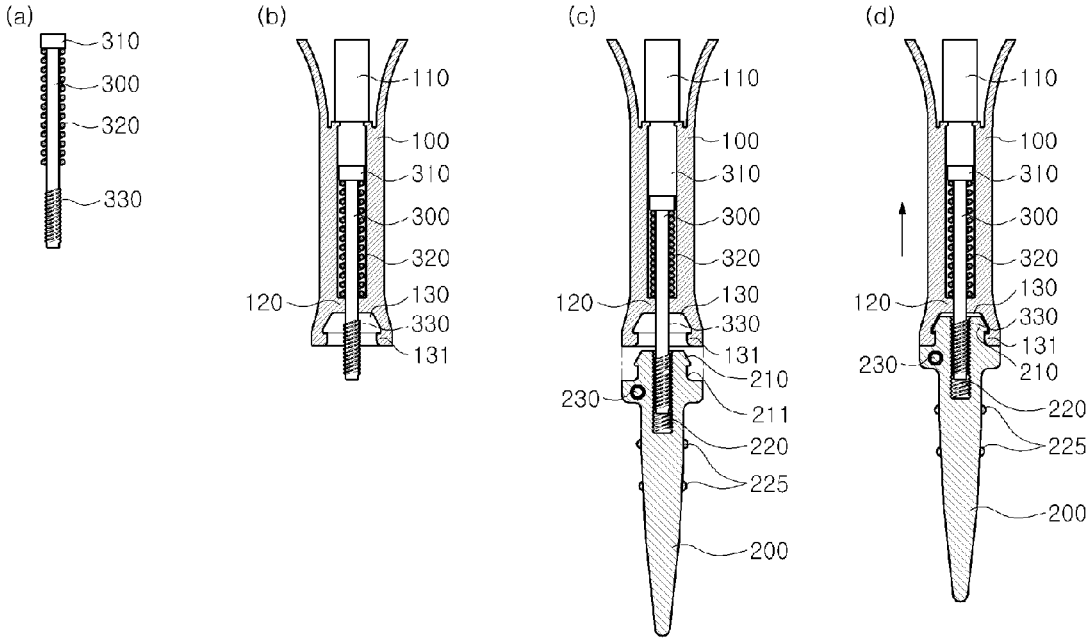
FIG. 9 is a view showing a procedure of assembling a golf tee according to an illustrative embodiment of the invention.
Figure 10:
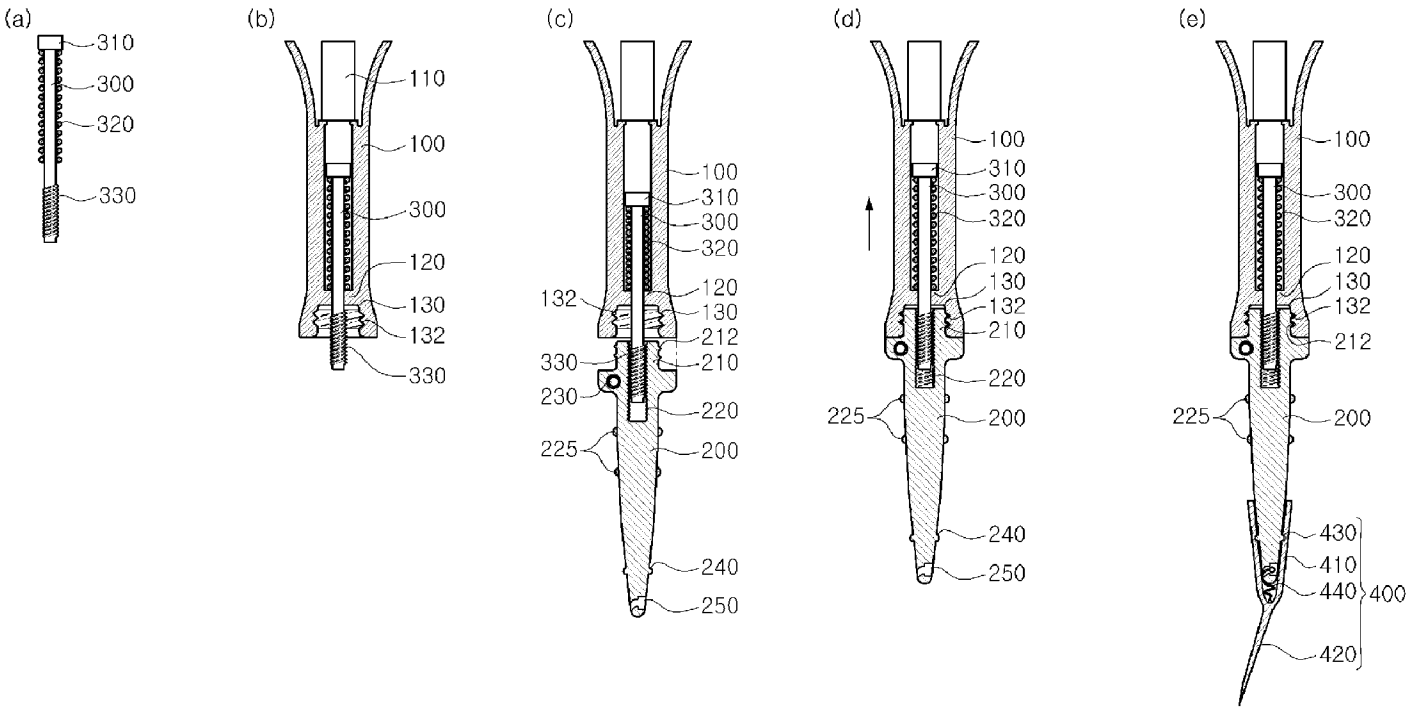
FIG. 10 is a view showing a procedure of assembling a golf tee according to another illustrative embodiment of the invention.

FIG. 9 is a view showing a procedure of assembling a golf tee according to an illustrative embodiment of the invention, and FIG. 10 is a view showing a procedure of assembling a golf tee according to another illustrative embodiment of the invention.

As shown in FIG. 9, the method of manufacturing a golf tee including a tubular hollow main body 100 having, at a lower portion of an inner circumference, a step part 120 below which a coupling groove 130 is formed, and an insertion pin 200 assembled with the main body and having an upper protrusion 210, through which an elongated screw hole 220 vertically extends from an upper central portion of the upper protrusion, and a lower pointed portion is provided. The method includes a stage S10 of providing an elastic connection pin 300 integrally having an upper large-diameter head part 310 and a body part extending from the head part and having a machined screw section 330 on a lower portion thereof and around which a spring 320 is integrally coupled to the head part 310; a stage S20 of pushing the elastic connection pin 300 down into the main body 100 such that the spring 320 is engaged against the step part 120 of the main body and the screw section 330 of the connection pin 300 protrudes out of a lower portion of the main body 100; a stage S30 of screwing the screw section 330 of the connection pin 300 protruding out of the lower portion of the main body 100 through the screw hole 220 of the insertion pin 200 so as to connect the connection pin 300 and the insertion pin 200, and a stage S40 of coupling the upper protrusion 210 of the insertion pin 200 into the coupling groove 130 of the main body.

As shown in FIG. 9(*a*), in the stage S10, the elastic connection pin 300 is provided by integrally forming the head part 310 on an upper portion of the rod-type body part, and integrally melting or adhesive-bonding the spring 320 fitted around the body part onto an undersurface of the head part 310 to integrate the head part 310 and the spring 320. That is, the spring 320 is integrally formed to the connection pin 300.

If needed, a stage of integrally bonding an elastic section 500 onto the upper surface of the head part 310 of the connection pin 300 to elastically support a golf ball is provided. Here, the elastic section 500 is provided by integrally bonding one side of a spring 510 onto the upper surface of the head part 310 of the connection pin 300 and then fixing a support piece 520 to another side of the spring 510.

As shown in FIG. 9(*b*), in the stage S20, the main body 100 is configured to have the coupling groove 130 having a leading engaging step 131, below the step part 120. The connection pin 300 in which the head part 310 and the spring 320 are integrally formed is pushed down into the main body 100 from the upper portion of the main body 100 so that the spring 320 is engaged against the step part 120, and the screw section 330 provided at the lower portion of the connection pin 300 protrudes out of the lower portion of the main body 100. Here, if the elastic section is provided, the support piece 520 is positioned inside the seat 110 of the main body so as to elastically support the golf ball to be loaded on the seat 110 of the main body 100.

As shown in FIG. 9(*c*), in the stage S30, the insertion pin is configured to have the protrusion 210 on the upper surface thereof which is inserted into the coupling groove 130 of the main body 100. The protrusion is configured to have the engaging groove 211 on the outer circumference and the screw hole 220 vertically extending from the upper central portion thereof. The connection pin 300 and the insertion pin 200 are coupled together by screwing the screw section 330 of the connection pin 300, which protruded out of the main body 100, to the screw hole 220 of the insertion pin 200.

As shown in FIG. 9(*d*), in the stage S40, the main body 100 and the insertion pin 200 are coupled together by inserting the protrusion 210 of the insertion pin 200 into the coupling groove 130 of the main body 100 such that the engaging step 131 of the coupling groove 130 is fitted into the engaging groove 211 formed on the protrusion of the insertion pin.

As shown in FIG. 10, the manufacturing method according to another embodiment of the invention includes similar stages to the stages S10, S20, and S30 of the former embodiment, except that in the stages S20 and S30, the coupling groove 130 of the main body 100 and the protrusion of the insertion pin are configured to have internal and external screw parts 132 and 212 on inner and outer circumferences thereof, respectively, and in the stage S40, the main body 100 and the insertion pin 200 are coupled by screwing the coupling groove 130 of the main body 100 to the protrusion 210 of the insertion pin.

Here, as shown in FIGS. 10(*a*), (*b*), and (*c*), the screw parts 132 and 212 of the protrusion 210 and the coupling groove 130 consist of a pair of male-female screw parts having one turn-type or one and a half turn-type. Thus, once the insertion pin has made one turn after the protrusion 210 of the insertion pin 200 is inserted into the coupling groove 130, the insertion pin is easily coupled to the main body 100.

As shown in FIG. 10(*e*), after the stage S30 or S40, a distal end of the insertion pin 200 is drilled to form an opening 250, and a flexible wire 430 is connected through the drilled distal end of the insertion pin to a repairing member 400 having a cap with a bottom, to which the flexible wire 430 is coupled, and an inclined, pointed part extending from an end of the cap, such that the repairing member is fitted around the lower portion of the insertion pin 200.

Here, instead of using the repairing member 400, the insertion pin 200 may be configured to have a lower portion that consists of an inclined rib 260 having a pointed end.

According to the present invention, when a main body and an insertion pin are assembled by inserting a connection pin into the main body, a screw section of the connection pin is screwed to a screw hole of the insertion pin to form a firm, stable assembly, thereby stably maintaining sufficient flexibility and elasticity of the connection pin when a golf ball is hit at the start of each hole, preventing the main body and the insertion pin from being separated and broken, and preventing the golf tee from being bent due to the flexibility of a spring when it is inserted into turf and therefore improving a quality of a product.

Further, the engagement between the main body and the insertion pin prevents a gold tee from being bent due to flexibility of a spring when inserting it into turf, thereby improving convenience of use.

Still further, parts such as a conventional support head, a support pin, and the like are not required, so the number of the parts is reduced, thereby saving on a manufacturing cost and maximizing productivity due to a simplified assembly process.

Although the embodiments of the present invention have been disclosed for illustrative purposes, those skilled in the art will appreciate that various modifications, additions and substitutions are possible, without departing from the scope and spirit of the invention as disclosed in the accompanying claims. Therefore, the claimed scope of the present invention is not limited to the illustrated embodiments, but should be defined by following claims and their equivalences.

The invention claimed is:

1. A golf tee comprising:

a main body having an upper seat on which a golf ball is supported;

an insertion pin having a lower pointed part; and a connection pin connecting the insertion pin and the main body, the connection pin including an upper integral-type head part and a body part extending from the head part and having a lower screw section on a lower end thereof and around which a spring is integrally fitted, the insertion pin having an elongated screw hole extending from an upper central portion thereof such that the screw part of the connection pin is screwed therethrough, wherein the main body is provided on a lower end thereof with a coupling groove, and the insertion pin is provided on an upper end thereof with a protrusion to be inserted into the coupling groove, wherein the coupling groove and the protrusion have a pair of male-female engaging steps, and wherein the coupling groove and the protrusion have a pair of male-female screw parts.

2. The golf tee according to claim 1, wherein a lower portion of the insertion pin is formed as an inclined rib having a pointed tip and having a repairing function.

3. The golf tee according to claim 1, wherein an inclined repairing member is detachably coupled to a lower portion of the insertion pin, the repairing member having a pointed tip.

4. The golf tee according to claim 3, wherein the repairing member has a cap coupled to the lower portion of the insertion pin, and an inclined, pointed rib integrally extending from an end of the cap.

5. The golf tee according to claim 4, wherein the lower portion of the insertion pin has a protrusion part on an outer circumference thereof, and the cap has, on an inner circumference thereof, a groove part into which the protrusion part is fitted.

6. The golf tee according to claim 5, wherein the insertion pin has an opening at a distal end thereof, through which a flexible wire is connected to the bottom of the cap.

7. The golf tee according to claim 1, wherein the insertion pin has a plurality of circumferential rings at regular intervals to indicate an insertion level of the insertion pin.

8. The golf tee according to claim 1, wherein an elastic section is further provided inside the seat of the main body such that one side thereof is integrally coupled to an upper surface of the head part of the connection pin, so as to elastically support a golf ball.

9. A method of manufacturing a golf tee comprising a hollow main body having, on an inner circumference, a step part below which a coupling groove is formed, and an insertion pin assembled with the main body and having an upper protrusion, through which an elongated screw hole vertically extends from an upper central portion of the upper protrusion, and a lower pointed portion, the method comprising:

a stage (S10) of providing an elastic connection pin having an upper large-diameter head part and a body part extending from the head part and having a screw section on a lower portion thereof and around which a spring is integrally coupled to the head part;

a stage (S20) of pushing the elastic connection pin, in which the spring is integrally coupled to the head part, down into the main body such that the spring is engaged against the step part of the main body and the screw section of the connection pin protrudes out of a lower portion of the main body; and a stage (S30) of screwing the screw section of the connection pin protruding out of the lower portion of the main body through the screw hole of the insertion pin so as to connect the connection pin and the insertion pin, wherein the method further comprises a stage of, after the stage of (S30) coupling the upper protrusion of the insertion pin into the coupling groove of the main body, the coupling groove and the upper protrusion are coupled using a engaging step and an engaging groove formed on the coupling groove and the upper protrusion, and the coupling groove and the upper protrusion are coupled using internal and external screw parts formed on the coupling groove and the upper protrusion.

10. The method according to claim 9, wherein a lower portion of the insertion pin is formed as an inclined rib having a pointed tip and having a repairing function.

11. The method according to claim 9, further comprising a stage of after the stage of (S30), drilling a distal end of the insertion pin, and connecting a flexible wire through the drilled distal end of the insertion pin to a repairing member having a cap with a bottom, to which the flexible wire is coupled, and an inclined, pointed part extending from an end of the cap, such that the repairing member is fitted around the lower portion of the insertion pin.

12. The method according to claim 9, wherein the stage of (S10) further comprises a stage of integrally coupling an elastic section to an upper surface of the head part of the connection pin to elastically support a golf ball.

* * * * *